US005705771A

United States Patent [19]

Flynn et al.

[11] Patent Number: 5,705,771

[45] Date of Patent: Jan. 6, 1998

[54] CRYOGENIC PROPELLANTS AND METHOD FOR PRODUCING CRYOGENIC PROPELLANTS

[76] Inventors: Thomas M. Flynn, 511 N. Adams Ave., Louisville, Colo. 80027; Thomas M. Murray, 15619 SE. 8th, Bellevue, Wash. 98008

[21] Appl. No.: 353,927

[22] Filed: Dec. 12, 1994

Related U.S. Application Data

[60] Division of Ser. No. 95,244, Jul. 20, 1993, abandoned, which is a continuation-in-part of Ser. No. 605,266, Oct. 29, 1990, abandoned.

[51] Int. Cl.[6] ..... C06B 47/00

[52] U.S. Cl. ..... 149/1; 149/109.6

[58] Field of Search ..... 149/1, 109.6

[56] References Cited

U.S. PATENT DOCUMENTS

| | | | |
|---|---|---|---|
| 2,759,418 | 8/1956 | Ross et al. | 102/24 |
| 2,886,424 | 5/1959 | Hyslop | 52/1 |
| 2,939,778 | 6/1960 | McKinley | 149/1 |
| 3,009,316 | 11/1961 | McKinley | 149/1 |
| 3,067,840 | 12/1962 | Toulminen . | |
| 3,069,840 | 12/1962 | Toulmin | 60/35.4 |
| 3,253,414 | 5/1966 | Herbst | 60/35.4 |
| 3,263,414 | 8/1966 | Herbst . | |
| 3,340,398 | 9/1967 | Winkler et al. | 250/83 |
| 3,354,662 | 11/1967 | Daunt | 62/10 |
| 3,377,801 | 4/1968 | Altman | 60/206 |
| 3,407,604 | 10/1968 | Keith et al. | 60/217 |
| 3,455,117 | 7/1969 | Prelowski | 62/45 |
| 3,470,040 | 9/1969 | Tarpley | 149/1 |
| 3,516,879 | 6/1970 | Paine | 149/1 |
| 3,521,457 | 7/1970 | Hemstreet | 62/45 |
| 3,521,458 | 7/1970 | Huibers | 62/45 |
| 3,691,769 | 9/1972 | Keilbach et la. | 60/217 |
| 3,779,009 | 12/1973 | Friedman | 149/1 |
| 4,074,627 | 2/1978 | Celgate | 102/313 |
| 4,305,256 | 12/1981 | Anderson | 62/48 |
| 4,811,556 | 3/1989 | Lau et al. | 60/206 |
| 4,835,959 | 6/1989 | Coffinberry | 60/206 |
| 4,901,525 | 2/1990 | Beveridge | 60/217 |

OTHER PUBLICATIONS

Sindt, "Mixing and Heat Transfer Characteristics of Slush Hydrogen,–" National Bureau of Standars, Boulder Colo. Cryogenics Div., Contract: NSB Proj. 2750550; NASA Order W–13300 (abstract), Nov. 1972.

Richards, "Cyrogenic Research and Dvelopment," (Progress Report, Period Ending 30 Sep. 1972) National Bureau of Standards, Boulder, Colo. Cryogenics Div, Contract: NASA Order W–13300. Notes: Cryogenic Research on Slush Hydrogen Heat Transafer and Hdry, Sep. 1972.

Akinaga, "Slush Hydrogen," Journalof the Fuel Society of Japan, pp. 107–118 (abstract) Jan. 1989.

Holzmann, *Chemical Rockets*, pp. 185–186, Marcel Dekker (1969) New York. (TL783 H65 1969).

Sutton, *Rocket Propulsion Elements*, 2nd Ed., p. 180, John Wiley & Sons, Inc. (1956) New York (TL78L59 1956).

(List continued on next page.)

*Primary Examiner*—Charles T. Jordan
*Assistant Examiner*—Anthony R. Chi
*Attorney, Agent, or Firm*—Stephen A. Gratton

[57] ABSTRACT

An improved cryogenic propellant which can be utilized as an improved rocket fuel, hypersonic vehicle fuel, aircraft fuel, explosive, or coolant is described.

The improved cryogenic propellant is illustrated by a mixture of liquid hydrogen and solid methane. As an example, an approximate 50/50 mixture by weight of liquid hydrogen and solid methane has a mixture density approximately 2.0 times that of liquid hydrogen alone. This increase in density is partially offset by a loss in ISP of about 8 percent, compared to that of liquid hydrogen alone, with oxygen. Broadly speaking, more of the improved fuel must be carried for a given mission to compensate for the loss in ISP. However, this weight penalty is offset by the 200 percent increase in density. Increased fuel density reduces fuel tank weight and drag.

20 Claims, 6 Drawing Sheets

OTHER PUBLICATIONS

Holzmann, *Chemical Rockets and Flame and Explosives Technology*, pp. 185–186, Marcel Dekker, New York (1969).

Sutton, *Rocket Propulsion Elements*, 2d Ed., p. 180, John Wiley & Sons, Inc., New York (1956).

Hiza and Herring, *Solid–Vapor Equilibrium in the System Hydrogen–Methane*, p. 182, ACE Plenum (1965).

Parker, *Dictionary of Scientific and Technical Terms*, 3d Ed. pp. 672, 1493, 1505. McGraw–Hill Book Company, New York (1984).

Vandor Wall, *Carbon Compound/Liquid Hydrogen Fuels*, Arrow Jet Nuclear Systems Company, Final Report, Project 396, Contract SNP I (1970).

Barlit, *J–T Liquefaction of Hydrogen–Hydrocarbon Gas Mixtures*, Adv. Cry. Eng., vol. 15, pp. 452–456 (1970).

CRYOGENIC PROPELLANTS AND METHOD FOR PRODUCING CRYOGENIC PROPELLANTS

CROSS-REFERENCE TO RELATED APPLICATIONS

This application is a division of application Ser. No. 08/095,244 now abandoned filed Jul. 20, 1993 which is a continuation-in-part of Ser. No. 07/605,266, filed Oct. 29, 1990 now abandoned, and entitled "Cryogenic Fuel Slurry".

FIELD OF THE INVENTION

This invention relates to new and improved high performance propellants and to methods for producing such propellants. More specifically the present invention relates to improved cryogenic propellant formulations suitable for use in aerospace rockets and hypersonic flight vehicles.

BACKGROUND OF THE INVENTION

The word propellant means either the fuel (chemical reducing agent) or the oxidizer, or a combination of the two, for propelling a rocket or hypersonic vehicle.

This invention describes the formulation for a new propellant. The new propellant is a new formulation of component substances. The formulation has propellant properties superior to any of the components alone.

Performance Parameters of a Liquid Propellant Rocket Engine

High performance propellants, especially for rockets and hypersonic air vehicles must meet five basic requirements: high energy density, excess heat capacity, fast chemical reaction time, ease of storage and handling, and high specific impulse. Each of these factors is discussed below.

High Energy Density

High energy density results in propellant containment tanks of lower empty tank weight and smaller tank volume than in the case of low density propellants.

Lower empty tank weight means that less propellant is used to accelerate the empty tank. Therefore, more propellant in a given situation is available to accelerate the payload. This empty tank weight parameter is relatively more important to vertical-take-off rockets than to air-breathing flight vehicles.

Lower tank volume means that the hypersonic flight assembly presents lower sail-area and causes less drag in the atmospheric portion of the flight. This tank volume parameter is relatively more important to air-breathing hypersonic aircraft.

Propellant density determines both the weight and volume of the propellant tanks. This relation is described by an important performance parameter, the propellant mass fraction $R_p$ of the complete vehicle, of which the engine system is a part. The propellant mass fraction is defined as $$R_p = \frac{\text{Usable propellant mass}}{\text{Initial rocket mass}}$$

where the initial rocket mass is equal to the sum of the masses of the engine system at burnout, the structure and guidance system, the payload, and the propellant. The significance of the propellant mass fraction can be illustrated by the basic equation for the rocket burnout velocity $V_{bo}$ (ft/sec):

$$V_{bo}=C_{vc}\, g(I_s)_{os}\, ln\ 1/(1-R_p)$$

where the coefficient $C_{vc}$ corrects for the effects of aerodynamic and gravitational forces. The larger $R_p$ the better. $R_p$ is largest for highest density propellants and smallest for lowest density propellants. The object of this invention is to create new high density propellants.

Hydrogen has the lowest liquid density known to man. This is an inescapable fact of liquid hydrogen behaving as a quantum fluid. This is true because liquid hydrogen possesses a high quantum mechanical zero-point energy relative to its classical thermal energy. According to classical theory, at absolute zero temperature, the particles of matter should be in static equilibrium with one another. Since they then have no thermal energy, perfect static balance is supposed to exist between the electromagnetic attractive and repulsive forces of the atoms.

Above zero Kelvin, however, all matter has thermal energy in the form of rapid random motion of its atoms, and the balance of forces among the particles becomes dynamic rather than static. In cooling matter slowly to zero Kelvin, then, classical theory would predict the loss of thermal energy of the material through the loss of the kinetic energy of its atoms, until at zero Kelvin there would exist perfect motionless order.

Quantum theory, on the other hand, shows that each atom has an irreducible minimum of kinetic energy amounting to ½ hv, where h is Planck's constant, $6.6\times10^{-27}$ erg sec, and v is the frequency of oscillation of the atom. Even at zero Kelvin, when a substance has lost all its thermal energy, it will still have this zero-point energy.

This amount is not large, and in most cases it is effectively inundated by the thermal energy of matter at higher temperatures. At very low temperatures, however, the zero-point energy becomes a significant fraction of the total energy of some substances.

Solid hydrogen, for example, has a zero-point energy of about 200 cal/mole, which counteracts about 50 percent of its computed lattice energy of 400 cal/mole. The measured heat of sublimation of hydrogen is, therefore, only 400–200=200 cal/mole. The zero-point energy acts as though it were additional thermal energy and effectively counteracts part of the attractive force between molecules of hydrogen. The practical result is that solid hydrogen melts very easily. Indeed, the thermal properties of solid hydrogen more resemble those of liquid helium than they do those of liquid hydrogen. Solid hydrogen melts readily and liquid hydrogen vaporizes very easily.

The zero-point energy of hydrogen manifests itself in greatly reduced liquid density, and greatly reduced heat of vaporization of liquid hydrogen. These two facts greatly negate the benefits of hydrogen as a propellant, and are inescapable facts of nature.

Excess Heat Capacity

Heat capacity is required of the propellant for cooling engines and aircraft components. It is common practice to circulate propellant through the engine before the propellant is burned. This practice helps keep the temperature of the engine components in a safe region. Thermodynamically, the highest possible engine temperature is desirable. Practically, the engine must not melt, soften, or otherwise become distorted. Additionally, propellant may be circulated through aircraft structural elements such as the leading edges of wings. This propellant coolant circulation also keeps these elements in a safe temperature region. Otherwise these elements would tend to overheat from friction with the air.

Fast Chemical Reaction Time

Fast chemical reaction time is required by the very nature of supersonic and hypersonic flight. Hypersonic usually means velocities approximately greater than 5 times the speed of sound. Hypersonic is equivalently defined as Math Number greater than about 5, or velocities greater than about 5,000 feet per second, or greater than about 1 mile per second. Insertion into Low-Earth Orbit (LEO) requires velocities of about 25,000 feet/sec or Mach Number of about 25.

A rocket engine is basically a chemical combustor or furnace. If an engine is 100 feet long, a molecule of fuel traveling at Mach Number 25 will completely pass through this engine in 4 milliseconds. The fuel has only 4 milliseconds to mix completely with the oxidizer and then to react chemically completely with the oxidizer. Hence, the requirement for fast mixing and chemical reaction time. Often, hydrogen is the only fuel molecule small enough and chemically reactive enough to meet this requirement.

Storage and Handling

Ease of storage and handling speaks to the practicality of the propellant. The propellant should not deteriorate significantly with time. For instance, the thermodynamically inevitable passage of heat into a stored cryogenic propellant should not materially reduce the desirable properties of the cryogenic propellant. Such heat transfer will cause the solid hydrogen in liquid hydrogen to melt readily as noted above. This property of slush hydrogen (very low heat of fusion and of the solid) is an enormous barrier to the use of slush hydrogen as a propellant.

Specific Impulse

The performance of a propellant is often expressed by a quantity commonly called "specific impulse," $I_s$. If the impulse imparted to the vehicle (F) and the corresponding propellant weight consumption (W) were measured during a given time interval, $I_s$ would have the dimension lb-sec/lb. $I_s$ may thus be expressed as $I_s$=F/W.

Since weight is the force exerted by a mass on its rigid support under the influence of gravitation (by convention at sea level on earth), it has become accepted practice to measure $I_s$ in "seconds," by canceling out the terms for the forces. Obviously, the expression does not denote a time, but rather a magnitude akin to efficiency. $I_s$ directly contributes to the final velocity of the vehicle at burnout and thus has a pronounced effect on range or size of payload, or both.

It is important to state whether a specific impulse quoted refers to the thrust chamber assembly only $(I_s)_{tc}$, or to the overall engine system $(I_s)_{os}$. Often, the distinction may not be self-evident. It is important, therefore, to state accurately to what system the quoted specific impulse refers. For instance, in a turbopump fed system, overall engine specific impulse may include turbine power requirements, vernier, and attitude control devices. All of these may be fed from one or all of a given vehicle's propellant tanks. If they are properly considered, the user, in this case the vehicle builder, will obtain the correct value for his own optimization studies, which include propellant tank sizes, payload weight, and range, among other parameters.

In many instances, statement of the specific impulse $(I_s)_{to}$ for the thrust chamber only may be desirable, such as during the component development period of this subassembly. Since, in that case, those propellant demands which are inadequately or not at all contributing to the generation of thrust are not included, the specific impulse stated will be higher than for a complete system, by 1 to 2 percent, as a rule. The specific impulse thus stated would be too high for the vehicle builder, who must consider the supply of propellants to the auxiliary devices mentioned above as well. If, due to improper identification of $I_s$, a thrust chamber value were used as an engine value, the consequences would be serious. This becomes clear, if one realizes that when relying on a better-than-actual value, propellant tank sizes would be designed too small, resulting in premature propellant depletion. This would eliminate the last seconds of required burning time, when the vehicle mass being accelerated is near empty weight and acceleration, therefore, is near maximum. A substantial loss of range for a given payload would result. The situation would be further complicated by the fact that it is nearly impossible to improve the specific impulse once an engine and thrust chamber have been designed for a given propellant combination.

Specific impulse is the thrust that theoretically can be obtained when unit weight of the propellant reacts in unit time, that is, pound thrust per pound per second of propellant flow. As shown, this ratio for specific impulse has the dimension of time and can be expressed as seconds. For example, a propellant having an impulse of 300 sec will theoretically deliver 300 lb of thrust when the propellant is consumed at the rate of 1 lb/sec. Alternatively, 1 lb of propellant will deliver 1 lb of thrust for 300 sec.

Thus, $I_s$ is a useful parameter for comparing one propellant with another, provided the distinctions noted above are stated, and the same $I_s$ is used throughout the comparison.

In this description, we shall use a standard rocket chamber specific impulse calculated from the equation shown below, where $I_{sp}$ is specific impulse; $T_c$, combustion temperature, in Rankine; M, molecular weight of combustion products; k, specific heat ratio of combustion products, $C_p/C_v$; $p_e/p_c$, ratio of external to chamber pressures.

$$I_{sp} = 9.80\sqrt{\frac{T_c}{M}}\ \sqrt{\frac{k}{k-1}}\ \sqrt{1-\left(\frac{P_e}{P_c}\right)^{\frac{(k-1)}{k}}}$$

The first square root term shows the importance of attaining high combustion temperatures and low-molecular-weight exhaust products. Low molecular weight exhaust products are obtained from using hydrogen as the propellant, since the exhaust product of hydrogen is water, $H_2O$, molecular weight of 18. The next term varies but little, since k ranges only between 1.2 and 1.3 for most propellants. The last term shows that the impulse of a given propellant varies with the operating conditions of the thrust chamber. Highest impulse is obtained when the chamber discharges into a vacuum, so that this term becomes unity.

At the high temperatures in rocket chambers, the products include not only those calculated for usual chemical reactions but also many additional components which result from dissociation. For example, the stoichiometric combustion of hydrocarbons with oxygen yields not only carbon dioxide and water but also carbon monoxide, hydrogen, oxygen, the hydroxyl radical OH, and atoms of hydrogen and oxygen. Temperatures, molecular weight, and specific-heat ratio are all influenced by the various equilibria and resulting compositions. Therefore the calculation of specific impulses is a complex procedure.

The following Table 1 shows peak-specific impulse for several propellant systems, taken from the book by Stanley F. Sarner. Propellant Chemistry, Reinhold, 1966. Note that for all of the fuels burned with oxygen, hydrogen has the highest specific impulse or ISP. This is a direct consequence of hydrogen having the lowest molecular weight exhaust product.

TABLE 1

PEAK-SPECIFIC IMPULSES FOR TYPICAL BIPROPELLANT SYSTEMS

| OXIDENT | $H_2$ | $N_2H_4$ | UDMH | $CH_2$ | $B_5H_9$ | Li | $BeH_2$ |
|---|---|---|---|---|---|---|---|
| $F_2$ | 412 | 365 | 348 | 328 | 361 | 378 | 355 |
| $ClF_3$ | 321 | 295 | 281 | 260 | 290 | 320 | 299 |
| $OF_2$ | 412 | 346 | 352 | 351 | 362 | 340 | 343 |
| $O_2$ | 391 | 313 | 310 | 300 | 320 | 247 | 331 |
| $H_2O_2$ | 322 | 287 | 284 | 278 | 309 | 271 | 353 |
| $N_2O_4$ | 341 | 291 | 285 | 276 | 299 | 240 | 316 |
| $HNO_3$ | 320 | 279 | 272 | 263 | 294 | 240 | 321 |

All data in Table 1 are for a 1,000-psia chamber pressure exhausting to 1 atm. UDMH is unsymmetrical dimethylhydrazine. $CH_2$ is a simplified representation of RP-1 (rocket propellant 1), a kerosene-type fuel. The atomic ratio in a typical RP-1 is one carbon atom for each two hydrogen atoms, $CH_2$, although no such compound exists. The equivalent C:H ratio for iso-octane high performance gasoline is $CH_{2.28}$, although no such compound actually exists. The best performance is obtained from the highest ratio of hydrogen to carbon. An object of this invention is to produce a new propellant where the hydrogen to carbon ratio is high, typically 20 to 1, rather than a mere 2 to 1. In addition, the H to C ratio of this invention my be varied from 2:1 to 100:1 by the designer.

As can be seen from the equation, ISP is inversely proportional to the molecular weight of the exhaust products. A water-rich exhaust ($H_2O$ MW=18) will have a greater ISP than a carbon dioxide-rich exhaust ($CO_2$ MW=44). Accordingly, the higher the hydrogen to carbon ratio (H:C) in the fuel, the better. RP-1 has a hydrogen carbon ratio of only 2:1, see above.

The improved fuel formulation described in this invention has a H:C ratio which may be varied at will. One such formulation to be described has an H:C ratio of 20:1, or ten times that of RP-1 (kerosene).

As stated, ISP is inversely proportional to the molecular weight of the exhaust products. The higher the H:C ratio of a propellant, the lower will be the molecular weight of the exhaust products. Therefore, the higher the H:C ratio of the fuel, the better the ISP.

Accordingly, our improved formulation with an H:C ratio of 20:1, for instance, will have an ISP greater than that of a kerosene fuel, whose H:C ratio is about 2:1.

Thus, one driving force toward better propellants is the search for higher H:C ratios. The ultimate H:C ratio is found in pure hydrogen. However, pure hydrogen has the lowest density of any substance on earth, as shown earlier. This property of pure hydrogen violates the premier criterion of propellants, namely high energy density.

Nonetheless, hydrogen is often the only choice as the propellant because:

Hydrogen mixes faster than anything else

Hydrogen burns faster than anything else

Hydrogen cools better than anything else

Hydrogen ISP is better than anything else

But

Hydrogen has a lower density than anything else which results in the heaviest empty tanks, largest sail area, largest aerodynamic drag, and lowest-mass fraction, $R_p$, of any propellant.

Attempts to overcome these shortcomings of hydrogen have led to a cryogenic fuel called slush hydrogen. In general, slush hydrogen is a mixture of liquid hydrogen and solid hydrogen at the triple point pressure (1.02 psia) and temperature (13.8 K.) of hydrogen. The mixture is usually about 50 percent of each phase, liquid and solid, although varying ratios of liquid and solid phase may be present. This fuel, because of its high energy content (i.e., high heat of combustion, high specific impulse content), is a highly desirable rocket and spacecraft fuel.

U.S. Pat. No. 3,455,117 to Prelowski, U.S. Pat. No. 3,521,457 to Hemstreet, U.S. Pat. No. 3,521,458 to Huibers, and U.S. Pat. No. 3,354,662 to Daunt all disclose methods for producing slush hydrogen.

A problem with slush hydrogen as a fuel is its relatively low density. With a 50 percent solid-liquid mixture, slush hydrogen has a density of approximately 5.1 lb/ft$^3$. Although this density is an improvement of about 15 percent over the density of normal boiling point liquid hydrogen alone, it still presents significant limitations as a fuel. Another object of this invention is to produce hydrogen densities of 200 percent more than liquid hydrogen.

Because of this low density a very large vehicle is required just to contain the hydrogen slush fuel. This necessitates the requirement for large volume containers and in general large volume vehicles. Consequently, such large vehicles are less efficient and more costly due to increased drag, weight, and structural requirements.

Another disadvantage of slush hydrogen as a fuel is the difficulty in handling and storing the fuel and in pumping the fuel through transfer lines. Slush hydrogen has a relatively low density (about 8 percent that of water) and exists normally at relatively low pressure, about 1 psia. This relatively low pressure can lead to the in-leakage of air and other gases and the attendant formation of explosive mixtures with hydrogen.

Yet another disadvantage of slush hydrogen as a fuel is its instability with respect to heat input. Any heat entering the hydrogen slush through, for example, pumping energy or inadequate insulation, goes directly to melt the solid hydrogen portion of the slush hydrogen mixture. When enough heat has accumulated to raise the temperature a fraction above the triple point temperature of hydrogen, all the solid hydrogen is melted and a slush no longer exists.

There is then considerable interest in the art in improving the fluid handling properties, density, temperature stability, and storability features of hydrogen as a cryogenic fuel.

Accordingly, it is an object of the present invention to provide an improved cryogenic propellant and method for producing such a propellant suitable for use as a fuel in aerospace rockets and hypersonic vehicles.

It is a further object of the present invention to provide an improved cryogenic propellant in which a hydrogen to carbon ratio of the propellant is high and which my be varied for specific applications.

It is a still further object of the present invention to provide an improved cryogenic propellant having liquid hydrogen as a component but with the addition of a hydrocarbon to provide a relatively higher hydrogen density than prior art fuels that utilize liquid hydrogen.

It is yet another object of the present invention to provide an improved cryogenic propellant which includes liquid hydrogen as a component but with the addition of a hydrocarbon and other compounds to improve the performance, stability and handling characteristics of the propellant.

It is yet another object of the present invention to provide an improved cryogenic propellant having an oxidizer and method for producing such a propellant.

SUMMARY OF THE INVENTION

In accordance with the present invention improved cryogenic slurries suitable for use as high performance propellants and methods for producing such propellants are provided. The cryogenic slurry includes as a major component liquid hydrogen in combination with other chemical compounds which improve the performance and handling characteristics of the cryogenic slurry for use as a propellant.

The cryogenic slurry of the invention generally stated comprises a mixture of liquid hydrogen and another fuel having a higher freezing point than the temperature of the liquid of hydrogen, slurried with the liquid hydrogen. In a preferred form of the invention, the cryogenic slurry includes a slurry of liquid hydrogen, and a solid hydrocarbon fuel such as methane contained in the liquid hydrogen at a predetermined concentration. This formulation yields an improved fuel with propellant properties superior to any of the individual components alone.

Thus, one representative embodiment of the improved propellant is the addition of a hydrocarbon fuel such as methane in a predetremined concentration to the cryogenic liquid hydrogen. A cryogenic fuel slurry is produced.

The basis of the improved fuel of the invention is liquid hydrogen. We add another fuel, such as methane, to the liquid hydrogen to improve the performance of both. This improved fuel mixture has properties superior to either component alone. The result is similar to using a fuel additive for enhancing the performance of an automotive fuel. As an example, one automotive fuel additive is sold under the trade name "$STP_{TM}$". The mixture of "$STP_{TM}$" and gasoline purportedly makes a better fuel than "$STP_{TM}$" or gasoline alone.

The core of the improved fuel of this invention is liquid hydrogen plus a hydrocarbon. The hydrocarbon can be methane, ethane, and propane in their aliphatic, olefin, or alkine forms. The hydrocarbon may be any of these substance, singly or in combination with other hydrocarbons. Hydrocarbon fuels are usually mixtures of hydrocarbons. Accordingly, the hydrocarbon fuel added may be any of the common hydrocarbon fuel mixtures known as kerosene, gasoline, the aircraft and rocket fuels, JP and RP series. The hydrocarbon fuel is added to the liquid hydrogen in significant predetermined proportions to have value as a propellant. Preferably, the concentration of the hydrocarbon for providing value as a propellant is about 5 percent by weight to about 75 percent by weight of hydrocarbon. The remainder is liquid hydrogen. The hydrocarbon or mixture of hydrocarbons in liquid hydrogen produces a new propellant with enhanced effectiveness compared to any of the original components alone.

In this invention, the hydrocarbon fuel is added to the liquid hydrogen fuel in concentrations great enough to have value as a propellant. We do not mean adding the hydrocarbon in low concentrations, which is sometimes done to influence physical properties such as solubility, viscosity, or other physical parameters. We mean to add the hydrocarbon to the liquid hydrogen in large enough concentrations to have a material effect on its effectiveness as a propellant. This formulation improves the combination of one physical property (density) and one chemical property, the heat of combustion. This combination of changing physical and chemical properties at the same time enables a new propellant of superior performance than heretofore possible. This formation results in a new propellant with properties superior to the individual components alone. In addition, the hydrocarbon fuel provides a framework or skeleton for adding other performance enhancers such as a gellant for improving the stability and handling characteristics of the fuel.

All propellant power derives from the reaction of a fuel and an oxidizer. An alternate embodiment fo the invention, therefore, includes both the fuel and oxidizer segments of a propellant—a formulation for an improved fuel and a formulation for an improved oxidizer. The improved fuel slurry and improved oxidizer of this invention may be used singly or together for rocket or hypersonic aircraft propulsion. Therefore, in the alternate embodiment of the improved propellant, a hydrocarbon fuel such as methane is added to the cryogenic liquid oxidizer, liquid oxygen.

The principal oxidizer for supersonic and hypersonic propulsion is oxygen. For reasons of higher density, the oxygen is carried in the liquid state, near the normal boiling point (NBP). The NBP of liquid oxygen is 90.18±0.01 Kelvins (K) and one atmosphere pressure, 14.696 pounds per square inch absolute, psia.

Our invention describes adding a hydrocarbon to the liquid oxygen at a selected pressure temperature and concentration. The resultant formulation has properties as a propellant superior to either of the separate components alone. In a preferred form of the alternate embodiments of the invention liquid oxygen and methane are mixed under such conditions described herein so that the methane remains in the liquid state. Thus, miscible mixtures of liquid oxygen/L-$CH_4$ may be formed of very wide mixture ratios. Such a cryogenic liquid propellant may have liquid oxygen/L-$CH_4$ concentrations equal to the stoichiometric ratio, not equal to this ratio, and even extending beyond the lower explosive limit (LEL) or the upper explosive limit (UEL) of $O_2/CH_4$ mixtures.

In one embodiment of this invention, the hydrocarbon added to the liquid oxygen is methane. The methane (freezing point 90.7 K.) freezes in the liquid oxygen (boiling point 90.1 K.) because the liquid oxygen is colder than the freezing point of methane. This combination could form a potentially explosive mixture because the solid methane composition in the inhomogeneous slurry ranges from 100 percent (pure solid methane) to 0 percent (pure liquid oxygen). It would resemble ice and water. In this physical state of solid methane slurried in liquid oxygen, a possible explosive mixture could exist. This slurry may also be shock-sensitive and difficult to handle safely.

However, if the pressure above the liquid oxygen is elevated, the temperature of the liquid oxygen rises accordingly. Raising the pressure of liquid oxygen may be accomplished by autogenous means, with a pressurant gas, or by mechanical and hydro-mechanical pressurization. An increase of pressure from 14.696 psia to approximately 15.303 psia is sufficient to raise the temperature of liquid oxygen to equal or exceed the freezing temperature of methane. Accordingly, elevated pressures may be used to produce a homogeneous, miscible mixture of liquid oxygen and liquid methane in almost any concentration of the two. In this invention, we describe a homogeneous, miscible, liquid/liquid mixture of methane in liquid oxygen. This embodiment is analogous to all the ice melting in an ice and water mixture. The former ice, now in the liquid state, is completely miscible with the water. In a similar way, elevated pressures of liquid oxygen may be used to achieve liquid/liquid mixtures of liquid oxygen plus other hydrocarbons and mixtures of hydrocarbons including, but not limited to methane. Some of these possible mixtures will hereinafter be described. Other suitable oxidizers in addition to liquid oxygen may include liquid fluorine and mixtures of liquid fluorine and liquid oxygen.

For illustrative purposes, the following hydrocarbons may be used singly or in any combination with liquid oxygen or another oxidizer as described above: methane, ethane, ethylene, acetylene, propane, propylene, and propyne.

System thermodynamic parameters may be chosen to make such illustrative mixtures become liquid/liquid or liquid/solid systems, as one desires.

It is pointed out that methane is of special interest as the preferred hydrocarbon additive to liquid oxygen because:

(1) Methane has the highest H:C ratio of all the hydrocarbons. Methane is a preferred means of storing and transporting hydrogen. Liquid hydrogen itself has less hydrogen per unit volume than liquid methane. Liquid hydrogen is a very poor carrier of hydrogen atoms.

(2) The proximity of the methane freezing point to the liquid oxygen normal boiling point facilitates achieving liquid/liquid mixtures of methane and liquid oxygen.

It is noted that the freezing point of ethylene, ethane, acetylene, propane, propylene, and propyne also lend themselves to forming liquid/liquid mixtures with liquid oxygen. The H:C ratio of these hydrocarbons is however, lower than that of methane. The heat of combustion in some cases is higher than that of methane. Engineering tradeoffs among these properties are possible.

It is possible with fuel slurries and mixtures constructed in accordance with this invention to form liquid/liquid mixtures of liquid oxygen and certain hydrocarbons. It is also possible to combine any ratio of hydrocarbon or hydrocarbons with liquid oxygen. Possible mixtures could include but are not limited to:

(1) Stoichiometric mixtures of liquid oxygen and a hydrocarbon or hydrocarbons.

(2) Oxygen-rich or oxygen-lean mixtures of liquid oxygen and a hydrocarbon or hydrocarbons.

(3) Mixtures that are outside the lower explosive limit (LEL) or the upper explosive limit (UEL) of the hydrocarbon or hydrocarbons and liquid oxygen mixtures. By forming liquid/liquid mixtures whose concentration of components is not within the explosive limits, relatively safe, stable mixtures of liquid oxygen and hydrocarbons are achieved heretofore impossible.

Additionally, the new cryogenic propellant of the invention is a monopropellant fuel and oxidizer, (e.g., liquid oxygen plus methane), in the liquid/liquid state. Therefore, the vehicle designer has the option of using only one set of containment tanks and one set of auxiliary equipment (e.g., insulation, instrumentation, pumps, etc.) with this new propellant.

An additional application of the new cryogenic propellant of the invention is an improved explosive for excavation, mining and demolition.

The new cryogenic propellant of the invention can be utilized as an improved explosive for the discharge of projectiles as in a weapon such as a gun or cannon.

The new cryogenic propellant of the invention can be utilized as an improved explosive in any detonating weapon system. For instance, liquid oxygen and the selected hydrocarbon or mixture of hydrocarbons may be used as a fuel-air-explosive (FAE) weapon.

DETAILED DESCRIPTION OF THE PREFERRED EMBODIMENT

Definition of Terms

As used herein the following definitions are applicable:

Slush—a solid/liquid mixture of an essentially pure component. Both the solid and liquid present are merely different physical phases of essentially the same chemical species.

An important distinction in the use of the term slush is that it refers to a solid/liquid mixture of an essentially pure component. Both the solid and liquid present are merely different phases of essentially the same chemical species. For instance, one skilled in the art of handling slush systems would consider the slush to be a physical mixture of solid and liquid phases of a pure or single component. A snowy slush, for instance, would be a mixture of solid (ice) and liquid (water), such as partly melted or watery snow.

Physical conditions at or near the triple point or melting point of the pure component must be maintained for the slush mixture of solid and liquid phases to exist in stable equilibrium. In the case of hydrogen slush, the triple point conditions are approximately 13.8 K, and 1.02 psia pressure.

Slurry—a free-flowing pumpable suspension of fine solid material in liquid. A slurry or suspension are terms used to describe a mixture of a solid and liquid phases of different chemical species. An example of a slurry is coal slurry, which is a mixture of solid coal suspended in liquid water. The solid component of a slurry is usually considered by one skilled in the art as insoluble or only partially soluble in the liquid phase.

In the simplest terms, then, a slush refers to solid and liquid mixtures of the same component (e.g., snowy slush), while slurry refers to solid and liquid mixtures of different components or even multi-components (e.g., a coal slurry).

Slush Hydrogen—a mixture of liquid hydrogen and solid hydrogen. The mixture is usually about 50 percent of each phase, although varying ratios of liquid and solid phase as well as different ortho/para hydrogen ratios, or isotopic modifications of hydrogen, may also be present.

Hydrogen—although the practice of the invention may be applied to normal hydrogen, that is, hydrogen having about 25 percent para and 75 percent ortho content, it is much more practical to employ the process only with para hydrogen. This is because at the low temperatures used herein hydrogen tends to spontaneously convert from the ortho form to the para form while evolving considerable amounts of heat (i.e., heat of conversion). As used herein the term liquid hydrogen preferably includes hydrogen having approximately 99.79 percent para hydrogen and 0.21 percent ortho hydrogen. This is by way of example however, and not by limitation, as any ratio of ortho/para concentration may be present for the practice of the invention. Additionally, any ratio of the isotopic forms of hydrogen, that is protium, deuterium, and tritium may be used for the practice of the invention.

Figure 1:
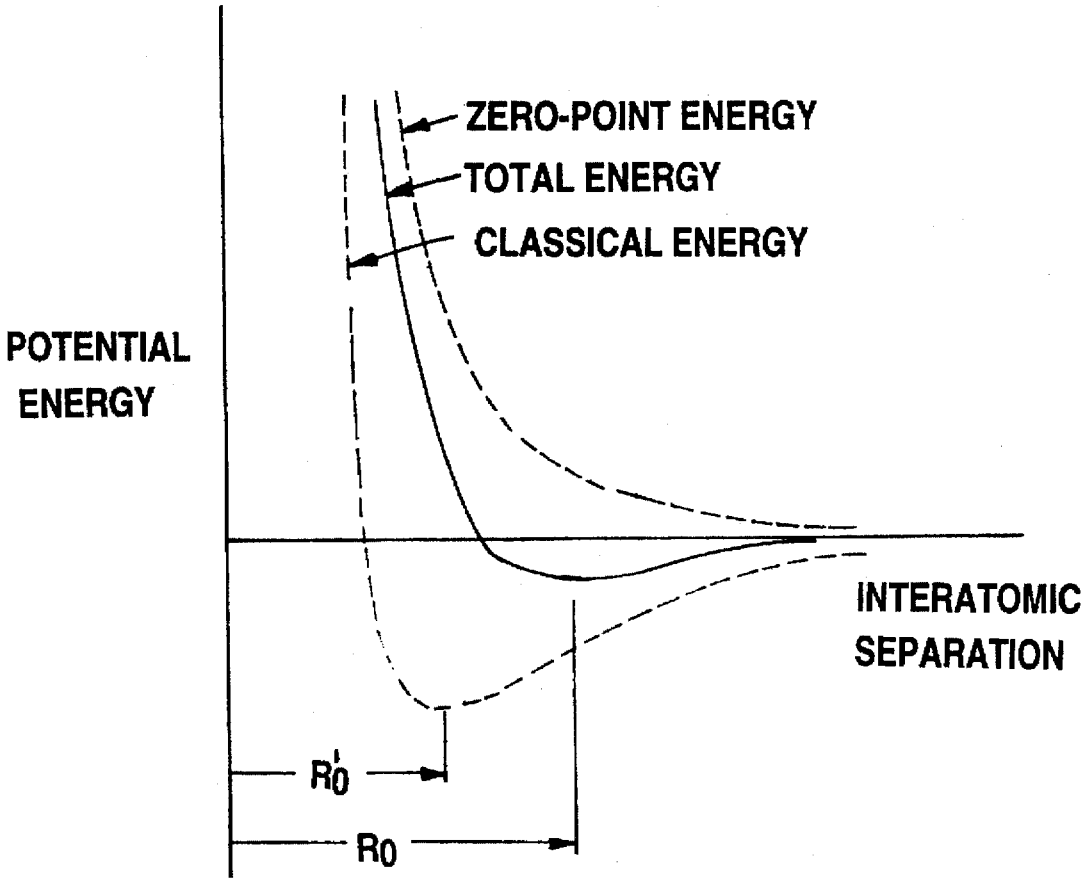
FIG. 1 is a graph of potential energy versus interatomic separation for liquid hydrogen and demonstrating the interatomic separation predicted by classical mechanics.

In FIG. 1, the lower dashed line shows the interatomic separation predicted by classical mechanics. Interatomic separation is inversely proportional to density. The larger the separation, the lower the density. Accordingly, large values of interatomic separation are undesirable for propellants. The upper dashed line is the interatomic separation predicted by the zero-point energy of liquid hydrogen. The average interatomic separation represented by the solid line is determined by a balance of these two forces and, hence, is considerably larger because of the zero-point energy.

In FIG. 1, $R_o'$ and $R_o$ are equilibrium separations before and after including the zero-point energy term. $R_o'$ describes the density of a classical fluid. $R_o$ is in fact the case for hydrogen, which gives rise to the lowest density of any liquid known. The density of liquid hydrogen is approximately that of a Styrofoam$_{TM}$ coffee cup. The density of liquid hydrogen is only 4.1 lb per cubic foot. By comparison, the density of water is 62.4 lb per cubic foot. The specific gravity of liquid hydrogen is 0.07. This low density of liquid hydrogen is the fundamental problem of using liquid hydrogen as a propellant.

FIG. 1 also shows the reduced depth of the potential well, which is related to the heat of vaporization. The heat of vaporization of liquid hydrogen is therefore greatly reduced from that of normal fluids. Liquid hydrogen therefore will evaporate more readily than any other fluid known, except helium. This property of hydrogen makes it extremely difficult to store and transport liquid hydrogen for propulsion purposes. The low heat of vaporization or melting is well illustrated by solid hydrogen.

Figure 2:
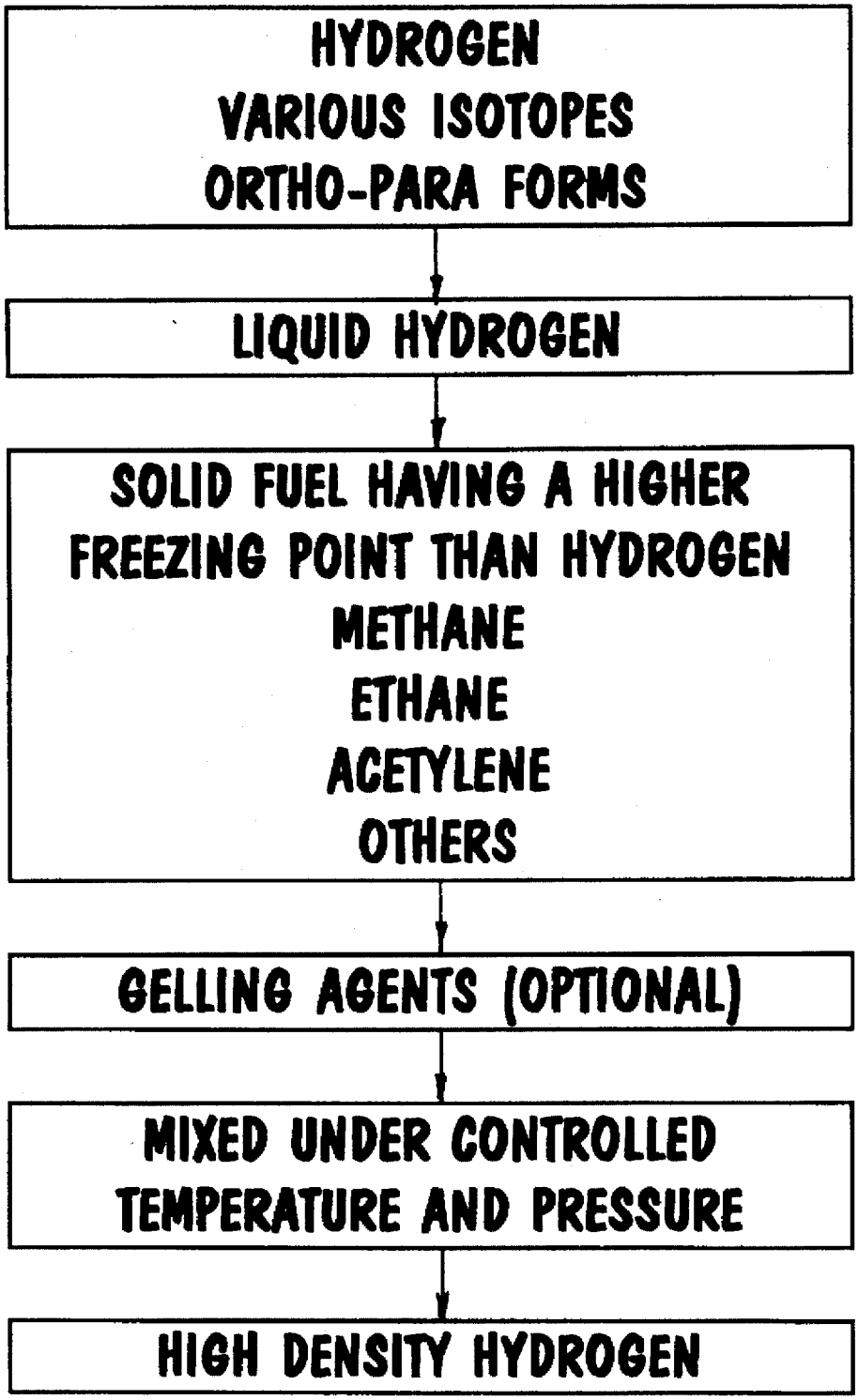
FIG. 2 is a schematic drawing showing production of hydrogen and a fuel slurry mixture in accordance with the invention.

With reference to FIG. 2 in a preferred embodiment the invention broadly stated comprises, a cryogenic fuel slurry including liquid hydrogen and a solid fuel having a higher freezing point than that of hydrogen mixed under conditions of controlled temperature and pressure. The solid fuel is preferably a solid hydrocarbon such as methane, and may also be another hydrocarbon or a multi-component mixture of hydrocarbons. This fuel is referred to herein as High Density Hydrogen.

Figure 3:
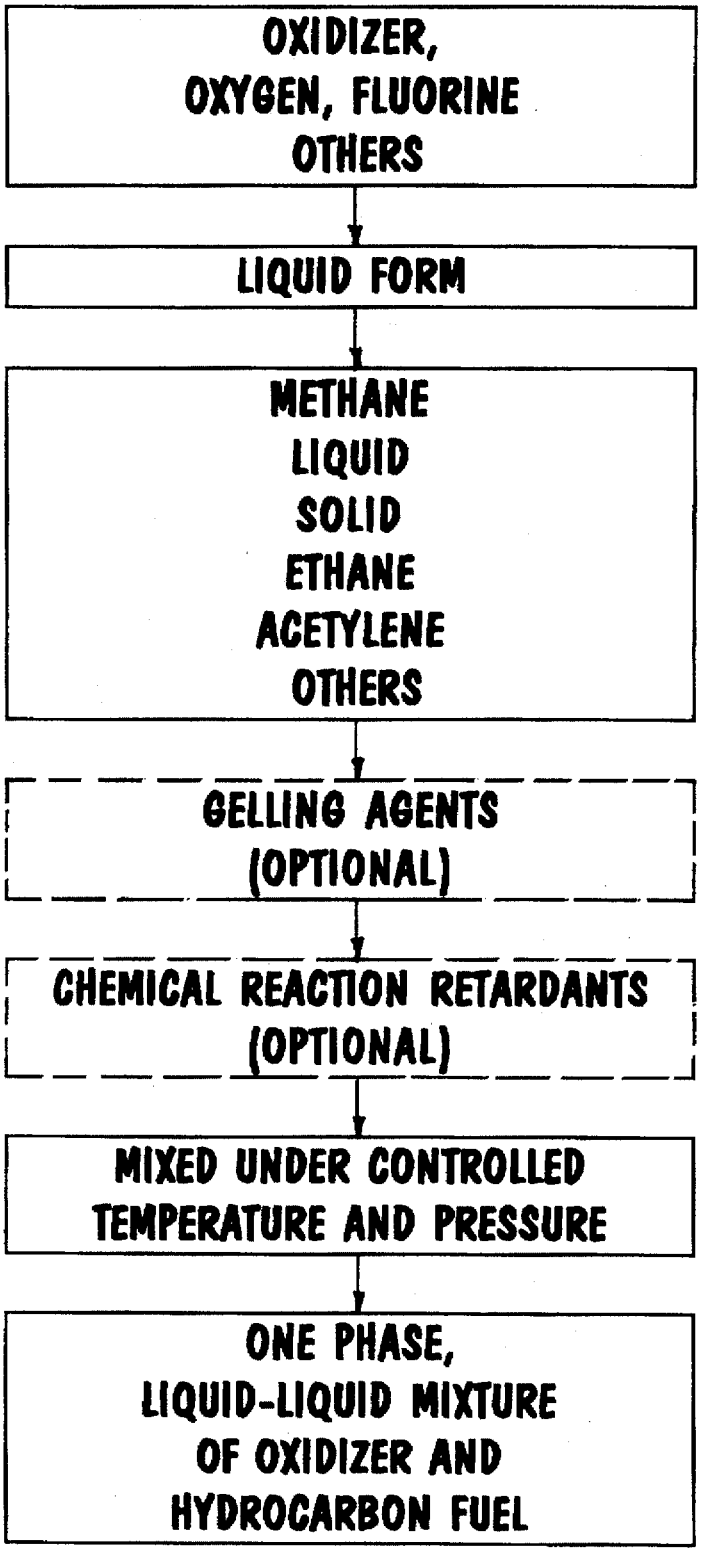
FIG. 3 is a schematic drawing showing production of an oxidizer and fuel monopropellant in accordance with the invention.

With reference to FIG. 3 in an alternate embodiment of the invention a cryogenic propellant may also be formed by a combination of an oxidizer and a hydrocarbon such as methane.

As a main component of a cryogenic fuel slurry formed in accordance with the invention, a solid fuel of a higher freezing point than that of hydrogen is suspended or contained in the liquid hydrogen component of the cryogenic slurry in propellant value proportion. As shown in FIG. 2, this may include a hydrocarbon such as methane, ethylene, ethane, or acetylene. The solid other fuel may be a single component such as methane or a multi-component mixture including a number of different hydrocarbon components.

As an illustration, a cryogenic propellant slurry may include a mixture of liquid hydrogen and a solid hydrocarbon which is added in propellant value proportions. A 50/50 mixture of solid methane and liquid hydrogen can be utilized as an example. This liquid would have a density of approximately 13.06 lb/ft$^3$ or 1.73 (173 percent) times as great as the density of liquid hydrogen alone.

Adding solid methane to liquid hydrogen does decrease the energy density over that of liquid hydrogen alone. A small decrease in energy density however, achieves a 173 percent increase in propellant bulk density. Vehicle drag and structural weight can now be much smaller than with liquid hydrogen alone, more than offsetting the small decrease in energy density of the hydrogen-methane slurry.

High Density Hydrogen is superior to slush hydrogen. Due to the high zero point energy of hydrogen, slush hydrogen is an extremely fragile system with respect to heat input. Any heat entering through imperfect insulation, or pumping energy, for instance, goes directly to melt the solid hydrogen portion of the slush hydrogen mixture. This, of course, immediately destroys the purpose of slush hydrogen. When enough heat has accumulated to raise the temperature a fraction above the triple point temperature of hydrogen, all the solid hydrogen has melted, and only liquid hydrogen remains. The system has been destroyed as far as being a slush. In the hydrogen-methane system to the contrary, a solid methane phase will exist even to the boiling point of liquid hydrogen and beyond, owing to the much higher freezing point of methane. The hydrogen-methane cryogenic slurry will be a very stable system compared to a slush hydrogen system.

In addition to the low energy density (by volume) possessed by slush hydrogen, slush hydrogen has another flaw: the solid fraction tends to aggregate unless mixing occurs. Mixing adds energy to the mixture, melting the solid. Our hydrogen-methane slurry will maintain the solid methane even if vigorously mixed or pumped, since the boiling temperature of hydrogen (T=20 K. approximately) is substantially below the freezing temperature of methane, by about 70 K.

Table 2 shows the hydrogen carrying ability of three substances. It will be noted that pure liquid hydrogen carries less hydrogen per unit volumn than does either methane ($CH_4$) or water.

TABLE 2

| FLUID | DENSITY AT NBP GMS/CC | MOLS/CC AT NBP | MOLS $H_2$ | RATIO TO $H_2$ |
|---|---|---|---|---|
| $H_2$ | 0.0707 | 0.03507 | 0.035070 | 1.00 |
| $CH_4$ | 0.5110 | 0.03194 | 0.063875 | 1.82 |
| $H_2O$ | 1.0000 | 0.05560 | 0.055600 | 1.58 |

The addition of a solid fuel such as methane to hydrogen in a cryogenic slurry thus in itself provides a substantial improvement over liquid hydrogen or hydrogen slush as a fuel.

In general, the new cryogenic propellants formed in accordance with the invention can be utilized in the art as follows:

A. For cryogenic propellants of liquid hydrogen and hydrocarbons.

1. Improved rocket performance.
2. Improved hypersonic vehicle performance.
3. Improved supersonic commercial and military aircraft performance.
4. Improved propellant handling characteristics, such as greater heat content, improved storage times, virtually no loss storage for fuel cells and spacecraft applications.
5. Improved ground support facilities by reason of the higher heat content and storability.

6. Simplified rocket, hypersonic vehicle, and supersonic aircraft design resulting from the higher bulk density and corresponding reduced empty tank weight.
7. Decreased structure weight due to less tankage, reduced insulation requirements, and less fuel need.
8. Reduced drag due to less tank surface area.
9. Improved energy density (by volume).
10. Increased radiant heat transfer due to the presence of the carbon and other species in the new propellant.
11. Improved safety due to increased flame visibility.
12. An improved refrigerant or coolant for vehicle systems.
13. A new cryogenic propellant of highly variable properties.

The invention describes a new formulation. This formulation may be varied at will within the limits stated, e.g., 5 percent to 75 percent by weight of solid methane (for instance) in liquid hydrogen. Because of this, it is possible to vary the formulation according to the specific requirements of density, ISP, heat of combustion, and energy content by volume. Heretofore, such a variation has not been available to vehicle designers. Heretofore, the vehicle designer was limited to one given set of properties of a given propellant. Furthermore, the hydrocarbon provides a skeleton for adding other performance enhancers to the fuel. As an example, a gelling agent such as water or methyl alchol may be added or slurried to the fuel to improve handling properties or characteristics of the fuel. Moreover, chemical reaction retardants may be added to improve the safety and handling characteristics of the fuel. The new flexibility in propellant properties provided to the hypersonic vehicle designer by this invention was heretofore simply not possible.

The designer was previously limited by the physical properties of the fuel (e.g., hydrogen) and oxidizer (e.g., liquid oxygen) making up the propellant.

Now, for the first time, this invention gives the designer a flexibility not previously available. The designer may chose the properties or characteristics of the fuel (e.g., liquid hydrogen plus methane) and of the oxidizer (e.g., liquid oxygen plus methane) and optimize them for a particular vehicle or vehicle mission. Never before has this flexibility existed.

Figure 4:
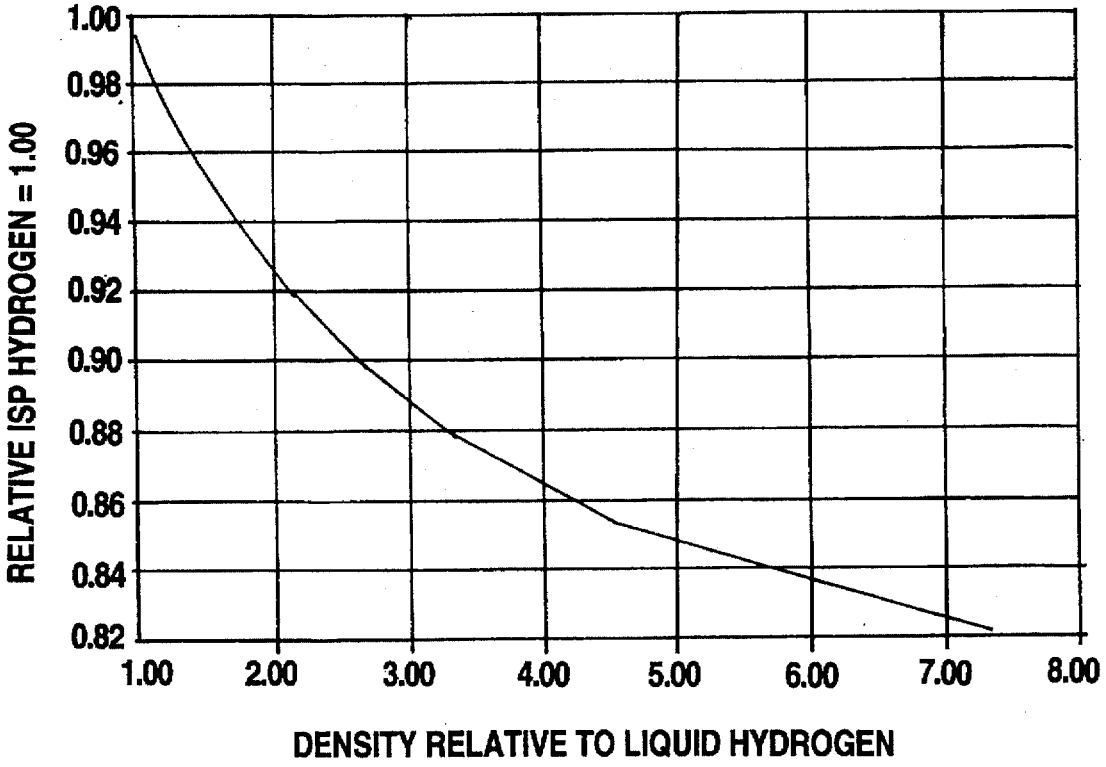
FIG. 4 is a graph plotting the relative specific impulse (ISP) Hydrogen=1.00 versus the density relative to liquid hydrogen illustrating Rocket ISP of a High Density Hydrogen/Oxygen mixture relative to that of the ISP of a Hydrogen/Oxygen mixture.

FIGS. 4–7 illustrate the very favorable characteristics of High Density Hydrogen for use in a fuel formulated in accordance with the invention. FIG. 4 shows the very favorable tradeoff of ISP and density of High Density Hydrogen. No attempt has been made to optimize the density/ISP choice, as this may be very dependent on vehicle mission. In fact, an added advantage of this new propellant is that it may be specifically compounded for specific missions.

Figure 5:
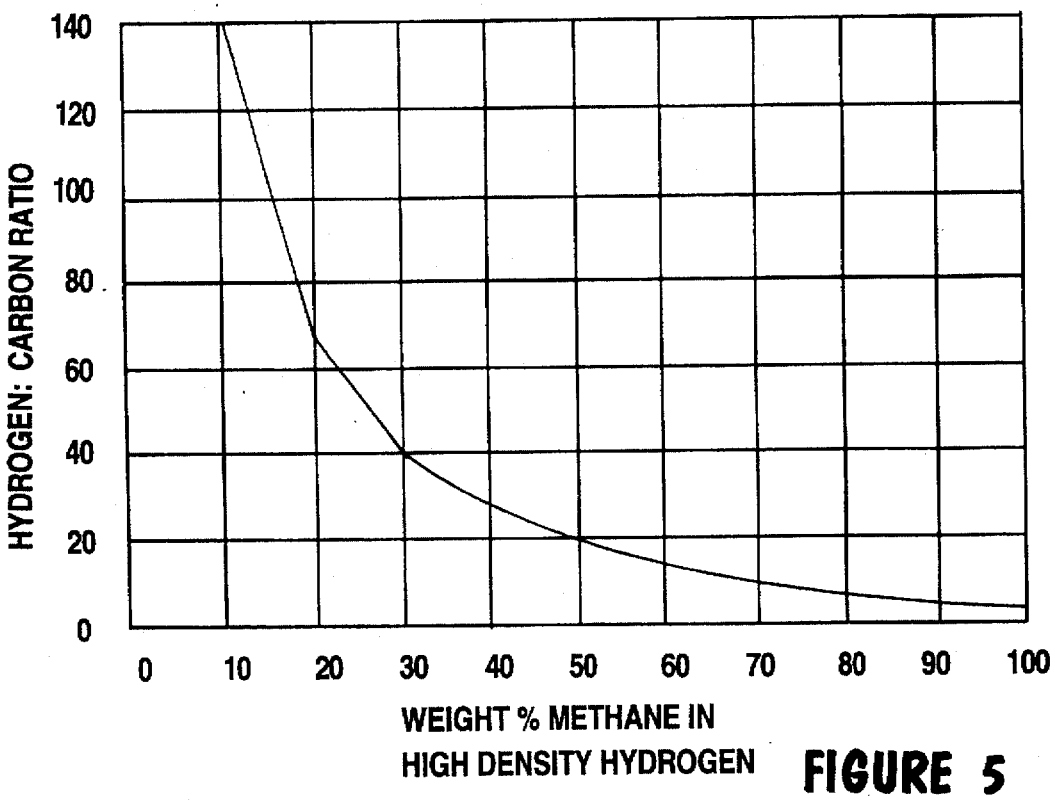
FIG. 5 is a graph plotting the Hydrogen:Carbon ratio versus Weight Percentage Methane in High Density Hydrogen.

FIG. 5 shows the relative H:C ratio for High Density Hydrogen. Note that iso-octane, an excellent aviation fuel, has an H:C ratio of only 2:25 to 1. The invention can have H:C ratio of 20:1 or more.

Figure 6:
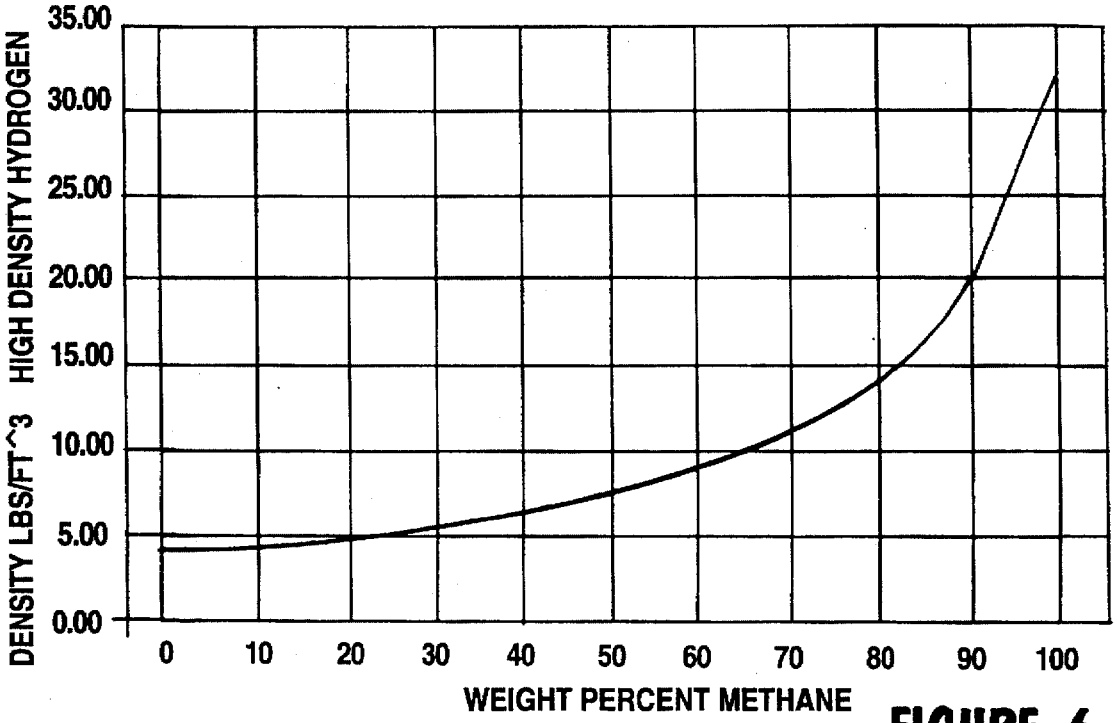
FIG. 6 is a graph plotting the density of High Density Hydrogen in U.S. customary lbs/ft$^3$ versus the Weight Percent Methane.

FIG. 6 shows the density of High Density Hydrogen as a function of methane composition.

Figure 7:
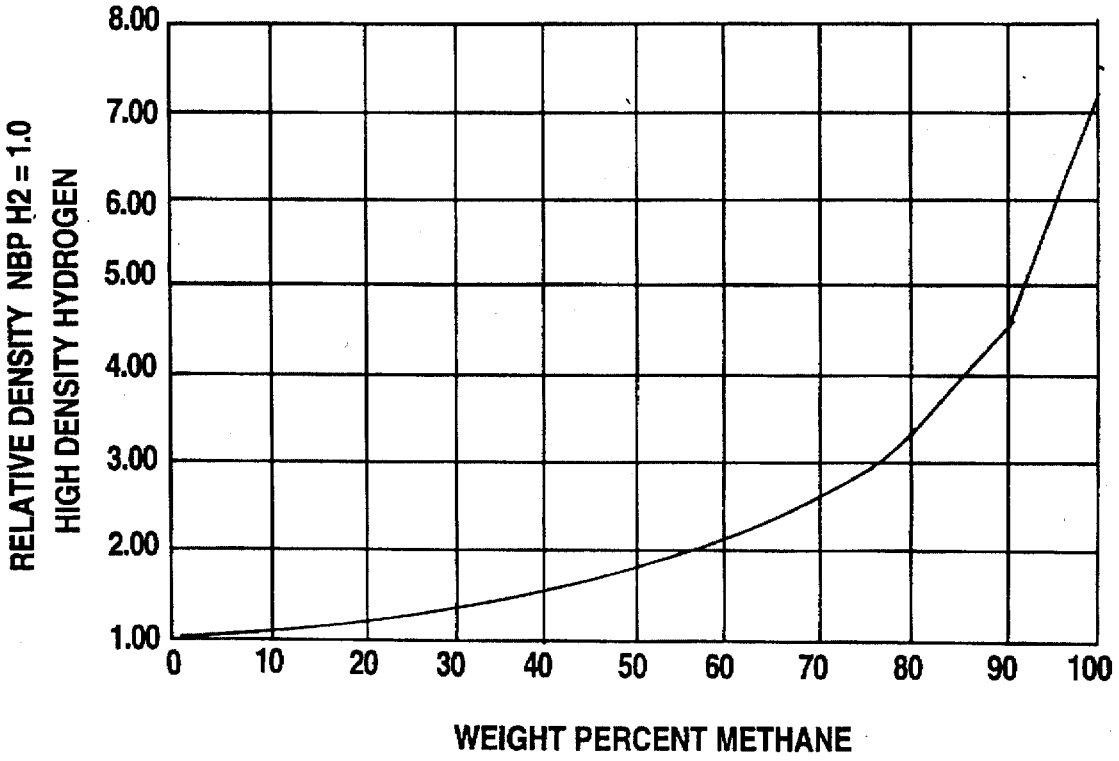
FIG. 7 is a graph plotting the density of High Density Hydrogen (relative to NBP $H_2$=1.0) versus Weight Percent Methane.

FIG. 7 shows the density of High Density Hydrogen relative to the density of pure liquid hydrogen, as a function of the weight percent of methane.

B. For liquid/liquid mixtures of fuels and oxidizer formed in accordance with the invention, the following additional benefits can be achieved.

1. Greatly simplified ground support equipment.
2. Greatly simplified vehicle design.
3. Greatly simplified motor (engine) design.
4. Reduced propellant system weight for aerospace applications since one fuel system is totally or partially eliminated by this invention.
5. Controlled burn due to potential addition of flame retardants or inert agents.
6. Improved energy density.
7. An improved explosive for excavation, mining demolition, weapons use, etc., resulting from the liquid/liquid mixture of liquid oxygen and a hydrocarbon.
8. An improved explosive for the discharge of projectiles as in a weapon such as a gun or cannon, or for weapons per se, such as fuel air explosive (FAE).

Thus, cryogenic propellants formed in accordance with the invention offer significant advantages over prior art cryogenic propellants.

While the invention has been described with reference to preferred embodiments thereof, as will be apparent to those skilled in the art, certain changes and modification scan be made without departing from the scope of the invention as defined by the following claims.

We claim:

1. A cryogenic propellant comprising:

liquid hydrogen; and a solid hydrocarbon slurried with said liquid hydrogen at a concentration of from 5 percent to 75 percent by weight of said hydrocarbon to weight of said propellant.

2. The cryogenic propellant as recited in claim 1 and wherein said solid hydrocarbon is methane.

3. The cryogenic propellant as recited in claim 1 and wherein said solid hydrocarbon is selected from the group consisting of methane, ethane, ethylene, acetylene, propane, propylene, and propyne.

4. The cryogenic propellant as recited in claim 1 and wherein said solid hydrocarbon is selected from the group consisting of a binary mixture of hydrocarbons and a multicomponent mixture including multiple different hydrocarbons.

5. The cryogenic propellant as recited in claim 1 and wherein said solid hydrocarbon comprises a hydrocarbon fuel selected from the group consisting of gasoline, kerosene, jet hydrocarbon fuels (JP series), and rocket hydrocarbon fuels (RP series).

6. The cryogenic propellant as recited in claim 1 and wherein said liquid hydrogen comprises a hydrogen slush.

7. A cryogenic propellant comprising:

liquid hydrogen at a selected temperature and pressure; and a solid hydrocarbon slurried with said liquid hydrogen at a concentration of from 5 percent to 75 percent by weight of said hydrocarbon to weight of said propellant to provide fuel value, an increased hydrogen density over said liquid hydrogen and an increased hydrogen to carbon ratio for said propellant.

8. The cryogenic propellant as recited in claim 7 and wherein the concentration of said solid hydrocarbon is selected to provide desired properties for the propellant.

9. The cryogenic propellant as recited in claim 7 and wherein said solid hydrocarbon is selected from the group consisting of methane, ethane, ethylene, acetylene, propane, propylene, and propyne.

10. The cyrogenic propellant as recited in claim 7 and further comprising a compound mixed with said propellant for combination with said solid hydrocarbon to provide a desired performance property for said propellant.

11. The cryogenic propellant as recited in claim 7 and further comprising a gellant configured to combine with said solid hydrocarbon for improving a handling property of said propellant.

12. A method for producing a cryogenic propellant comprising:

providing liquid hydrogen at a selected temperature and pressure;

slurrying a solid hydrocarbon with said liquid hydrogen at a concentration of from 5 percent to 75 percent by weight of said solid hydrocarbon to weight of said propellant to provide value as a propellant to provide an increased hydrogen density over said liquid hydrogen and to provide a high ratio of hydrogen to carbon for said propellant.

13. The method as recited in claim 12 and further comprising selecting the concentration of said solid hydrocarbon in said liquid hydrogen to provide said propellant with desired properties.

14. The method as recited in claim 13 and wherein the concentration of said solid hydrocarbon in said liquid hydrogen is selected to provide a hydrogen to carbon ratio for said propellant of from about 2:1 to about 100:1.

15. The method as recited in claim 13 and wherein the concentration of said solid hydrocarbon in said liquid hydrogen is selected to provide a hydrogen to carbon ratio for said propellant of from about 140 to 1.

16. The method as recited in claim 13 and wherein the concentration of said solid hydrocarbon in said liquid hydrogen is selected to provide a hydrogen density for said propellant of up to 200 percent more than a density of said liquid hydrogen without said hydrocarbon.

17. The method as recited in claim 13 and wherein said solid hydrocarbon is methane slurried with said liquid hydrogen at a concentration of about 50 percent by weight/methane to weight/propellant to provide a density for said propellant of about 1.73 times the density of said liquid hydrogen without said methane.

18. The method as recited in claim 13 and further comprising selecting the concentration of said solid hydrocarbon to provide at least one desired property for said propellant selected from the group of properties consisting of specific density, specific impulse (ISP), heat of combustion, and energy content by volume.

19. The method as recited in claim 13 and further comprising adding a compound to said propellant for combination with said solid hydrocarbon for improving a performance characteristic of said propellant.

20. The propellant produced by the method of claim 12.

* * * * *